US009539710B2

(12) United States Patent
Heimmer

(10) Patent No.: US 9,539,710 B2
(45) Date of Patent: Jan. 10, 2017

(54) SELF-ALIGNING PLUG REMOVAL DEVICE AND METHOD THEREFOR

(71) Applicant: JPP Marine, LLC, Surprise, AZ (US)

(72) Inventor: Darlene M. Heimmer, Surprise, AZ (US)

( * ) Notice: Subject to any disclaimer, the term of this patent is extended or adjusted under 35 U.S.C. 154(b) by 0 days.

(21) Appl. No.: 14/509,476

(22) Filed: Oct. 8, 2014

(65) Prior Publication Data

US 2015/0026941 A1 Jan. 29, 2015

Related U.S. Application Data

(63) Continuation-in-part of application No. 12/959,342, filed on Dec. 2, 2010, now Pat. No. 8,875,369.

(60) Provisional application No. 61/283,285, filed on Dec. 2, 2009.

(51) Int. Cl.
*B25B 27/02* (2006.01)

(52) U.S. Cl.
CPC ..... *B25B 27/023* (2013.01); *Y10T 29/49817* (2015.01); *Y10T 29/49822* (2015.01); *Y10T 29/5387* (2015.01); *Y10T 29/53657* (2015.01); *Y10T 29/53848* (2015.01); *Y10T 29/53909* (2015.01)

(58) Field of Classification Search
CPC ..... B25B 27/023; Y10T 29/5387; Y10T 29/49817
See application file for complete search history.

(56) References Cited

U.S. PATENT DOCUMENTS 4,092,770 A * 6/1978 Polashak ..... B25B 27/0064 29/283
4,672,731 A * 6/1987 Taylor ..... B25B 27/023 29/259
7,699,012 B2 * 4/2010 Cotten ..... B63B 17/0018 114/197
8,875,369 B2 * 11/2014 Heimmer ..... B25B 27/023 114/197

* cited by examiner

*Primary Examiner* — Minh Trinh
(74) *Attorney, Agent, or Firm* — Thomas W. Galvani, P.C.; Thomas W. Galvani

(57) ABSTRACT

A plug removal device for removing a plug from an access port located below a deck includes retracting means and a framework supporting the retracting means at an elevated position with respect to the deck. The framework is rigid and has a central axis. The retracting means produces a retracting force along a retracting axis. In response to the retracting means producing the retracting force, the framework moves along the deck to align the retracting axis with the central axis.

5 Claims, 8 Drawing Sheets

SELF-ALIGNING PLUG REMOVAL DEVICE AND METHOD THEREFOR

CROSS-REFERENCE TO RELATED APPLICATIONS

This application is a continuation-in-part of currently-pending U.S. patent application Ser. No. 12/959,342, filed Dec. 2, 2010, which is a non-provisional application claiming the benefit of U.S. Provisional Application No. 61/283,285, filed Dec. 2, 2009, both of which are hereby incorporated by reference.

FIELD OF THE INVENTION

The present invention is generally related to jet-pump engine equipment and is more particularly related to devices and methods for cleaning debris from jet-pump engines.

BACKGROUND OF THE INVENTION

Jet boats use jet-pump engines which draw in water through an intake and expel the water at very high speeds and pressures through a nozzle at the stern of the boat. Effective and efficient performance of the jet-pump engine depends on the continuous and unrestricted provision of water into the intake. Sea grass, floating garbage, and other debris can become lodged in the intake or actually enter the jet-pump engine and impair the performance of the jet-pump engine or render the engine completely inoperable. When that happens, the debris must be cleaned out.

Jet-pump engines typically have a debris cleanout access which allows jet boat operator to access and clean the intake. The debris cleanout access is generally disposed over the intake on a swim deck of the jet boat allowing easy access, and the debris cleanout access is capped with a plug. The plug is usually secured in the debris cleanout access in a press-fit engagement, and when routine maintenance procedures are followed, the plug can be easily removed by retracting it from the access with a moderate amount of force. Sometimes, a light tap with a mallet is required to first loosen the plug before retracting it.

Unfortunately, a number of factors can cause the plug to become stuck in the debris cleanout access. Many boat operators fail to follow routine maintenance procedures and instead allow long periods of neglect to pass before the plug is removed, by which point, removal is made very difficult. Further, when a jet boat is used in salt water, corrosion, mineral deposit accumulation, and barnacle growth can seal the plug into the debris cleanout access, making removal of the plug very difficult.

When the plug is stuck in the debris cleanout access, jet boat operators will try many different tools and methods to loosen the plug. Many of these methods are damaging to the plug or to the swim deck surrounding the plug. For instance, a jet boat operator will often attach a rope between a piece of lumber or pole and the plug, stand over the plug, and pull straight up. If the plug does come loose, the operator can hit himself with the lumber or pole, or fall off the swim platform. Other times, the operator may place a lever, such as a piece of lumber or a pole, between the swim deck and a handle of the plug and attempt to "lift" the plug out of the debris cleanout access. This imparts a tremendous amount of localized force on the swim deck, which can cause the swim deck to crack. Further, while this places a large amount of vertical force on the plug, it also places a good amount of lateral force on the plug, which can damage the plug or the engagement between the plug and the debris cleanout access, reducing future fits between the plug and the debris cleanout access. Occasionally, the plug is so damaged that it has to be replaced completely, and the plugs cost several hundred dollars. Bodily injury, of course, is always a risk, too; the operator can strain his or her back or be hit by the tool used to extract the plug. Thus, there exists a need for an improved device and method which simply and easily removes the debris cleanout access plug without causing damage to the swim deck, the debris cleanout access, or other parts of the jet boat.

SUMMARY OF THE INVENTION

Generally, a plug removal device includes retracting means and a strong, rigid framework supporting the retracting means at an elevated position with respect to a deck. The framework has a central axis. The plug removal device is disposed over a plug in an access below deck, and the retracting means is attached to the plug. The retracting means produces a retracting force along a retracting axis. In response to the retracting means producing the retracting force, the framework moves along the deck to align the retracting axis with the central axis. The retracting means breaks when the retracting force equals a predefined break strength which is less than a break strength of the deck, so as to prevent damage to the deck.

BRIEF DESCRIPTION OF THE DRAWINGS

Referring to the drawings.

DETAILED DESCRIPTION

Figure 1:
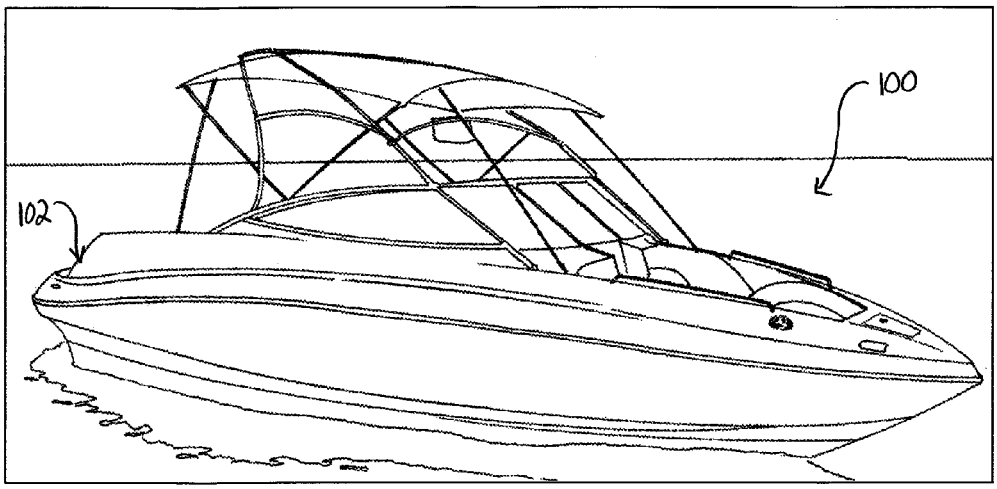
FIG. 1 is a side perspective view of a jet boat typical of that with which a plug removal device would be used.
Figure 2:
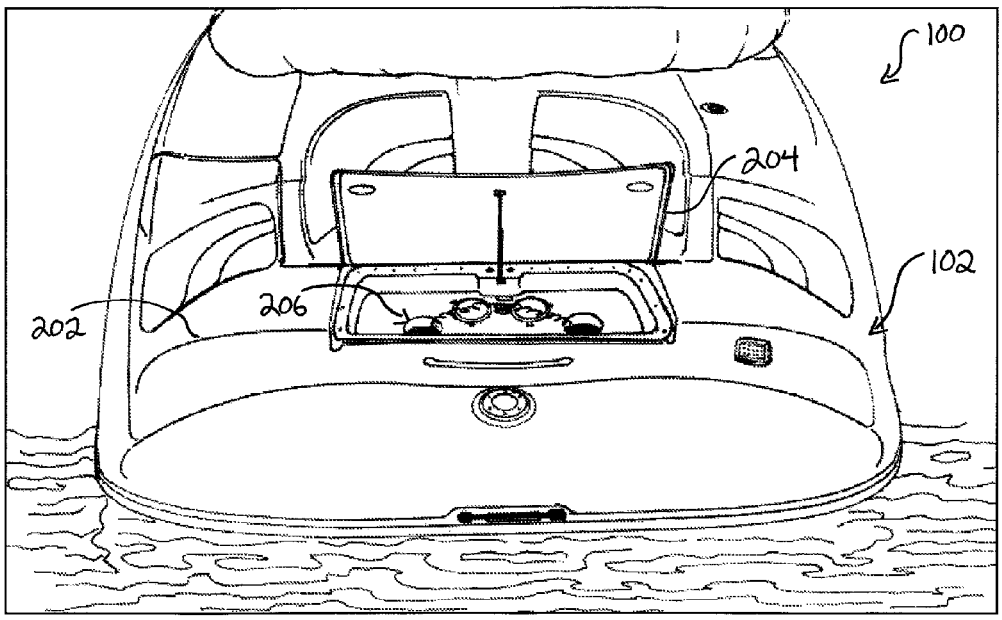
FIG. 2 is a rear perspective view of the jet boat of FIG. 1 illustrating a debris cleanout access providing access to a debris cleanout access plug.

Reference now is made to the drawings, in which the same reference characters are used throughout the different figures to designate the same elements. Turning to FIG. 1, a side perspective view of a jet boat 100 with a self-aligning plug removal device is shown. The jet boat is conventional and has a jet-pump engine. Although the plug removal device is described herein as being useful with a jet boat, it is also useful with jet skis and other vehicles with jet-pump engines. A swim deck (not shown) is located at a stern 102 of the jet boat 100. FIG. 2 illustrates the stern 102 of the jet boat 100 and the swim deck 202. An open hatch cover 204 at the swim deck 202 allows access to a debris cleanout access 206, which is a port leading into the jet-pump engine. A debris cleanout access plug (not shown) is fit into the debris cleanout access. The debris cleanout access plug may be subjected to large forces and pressures during operation of the jet boat 100, and is therefore held tightly in the debris cleanout access. The debris cleanout access plug provides a convenient means for a jet boat operator to remove debris that has entered the intake of the jet-pump engine.

Figure 3:
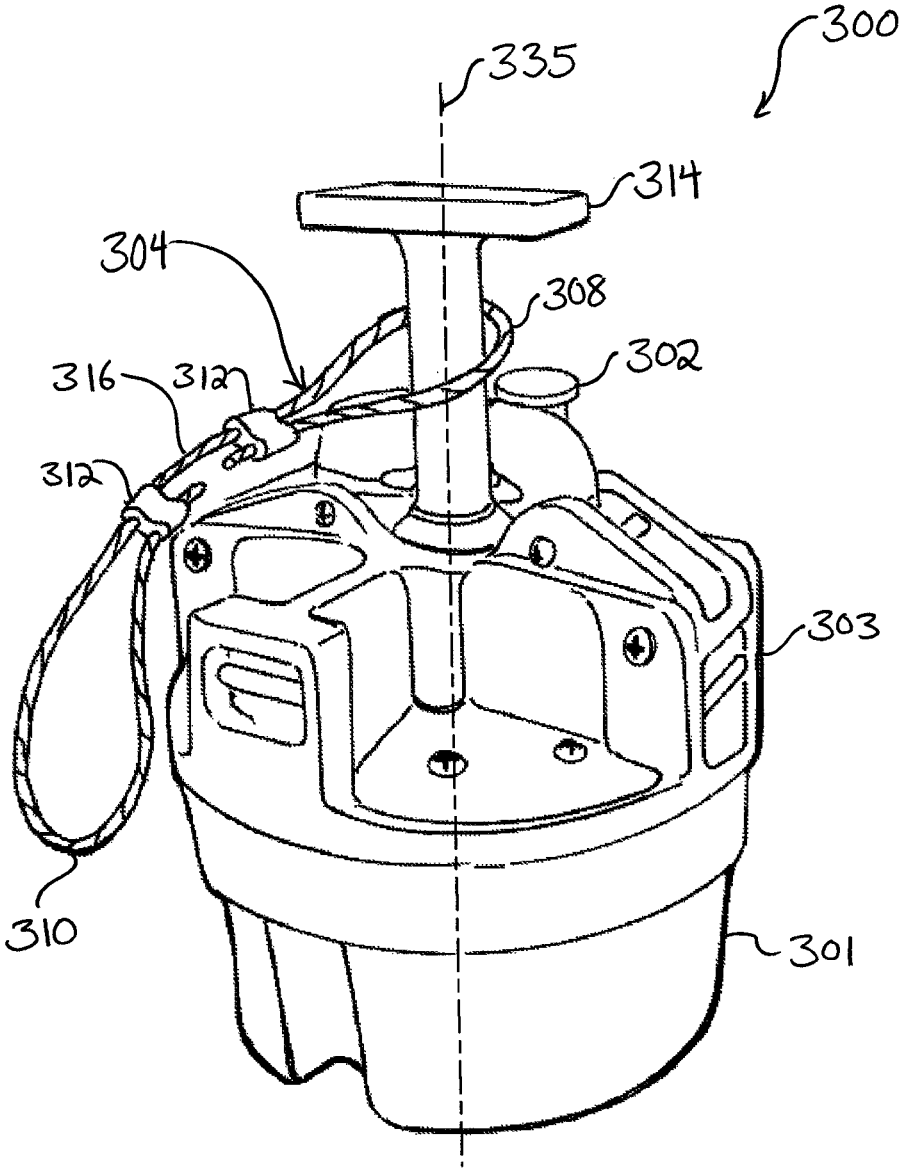
FIG. 3 is a perspective view of the debris cleanout access plug in isolation.

The debris cleanout access plug 300 (hereinafter, the "plug 300") is shown in isolation in FIG. 3, removed from the debris cleanout access 206 in which it is fit during operation. The plug 300 includes a wide, generally cylindrical base 301 and a top 303 from which a T-shaped handle 314 extends vertically. The plug 300 generally has rotational symmetry with respect to a plug axis 335 extending verticaly through the plug 300 and through the handle 314. The plug axis 335 is considered a central axis as it extends generally through the center of the plug 300. An unlock button 302 in the top 303 is activated by pushing down on the unlock button 302 to unlock the access plug 300 from the debris cleanout access 206, allowing the plug 300 to be removed from the debris cleanout access 206.

A lanyard assembly 304, constituting part of the plug removal device 400, is applied to the plug 300 and includes a first loop 308 and an opposed second loop 310 of twisted cable. The first and second loops 308 and 310 are formed by looping the cable at its opposed ends and securing the ends with clamps 312 that crimp the cable together. As shown in FIG. 3, the first loop 308 is removably applied to the handle 314, thus defining a catch looped around the handle 314.

Figure 4:
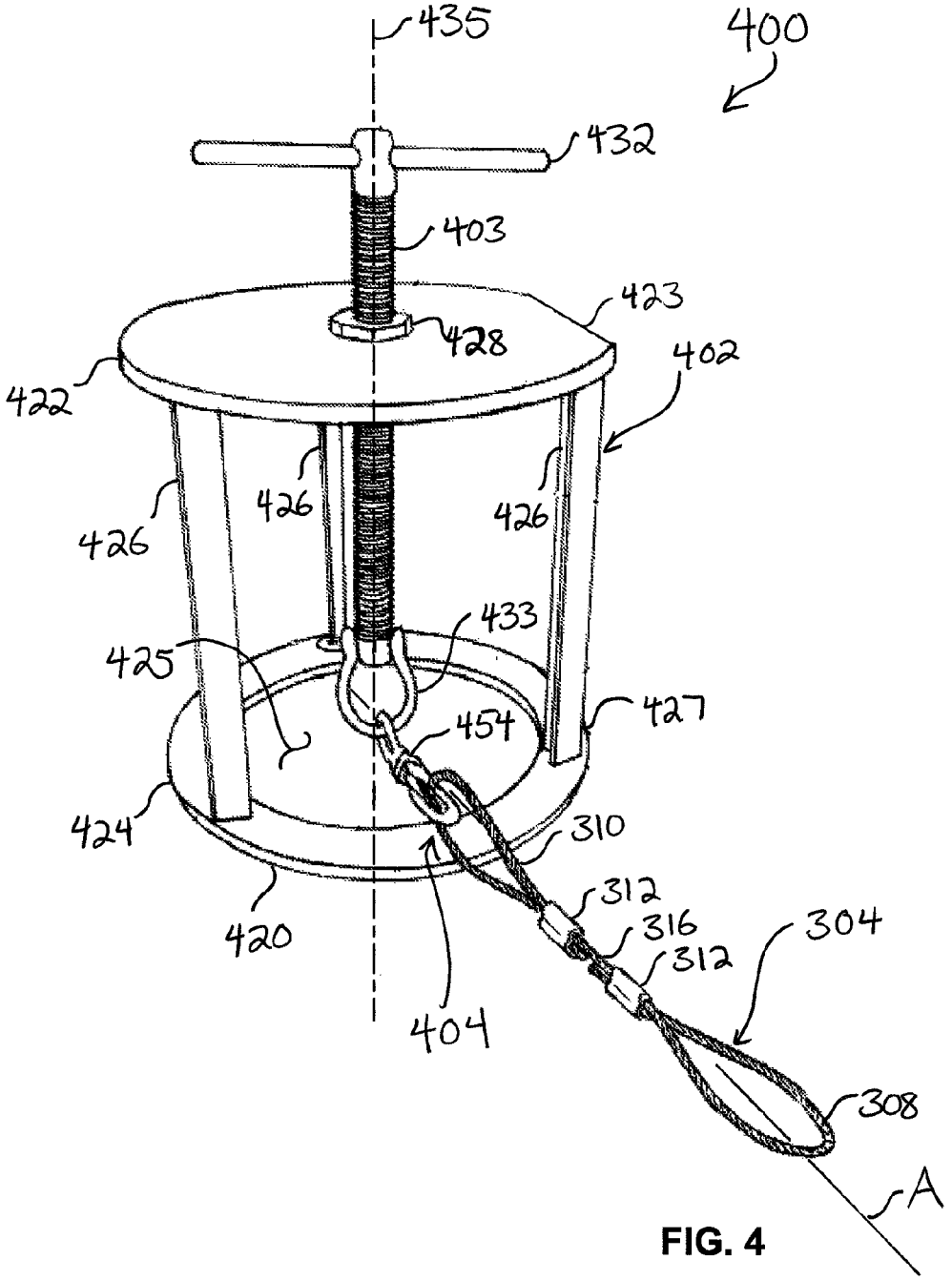
FIG. 4 is a perspective view of a plug removal device.

FIG. 4 is a top perspective of a plug removal device 400 useful for removing the plug 300 described above from the debris cleanout access 206. The plug removal device 400 has a framework 402 with a top plate 422, an opposed base or bottom plate 424, and a plurality of strong, rigid struts 426 extending therebetween. The bottom plate 424 is generally circular and has a circular opening 425 defined by an inner diameter of the bottom plate 424, which is greater than an outer diameter of the plug 300 and greater than an outer diameter of the debris cleanout access 206. The bottom plate 424 has a flat edge 427, which corresponds in length and orientation on the plug removal device 400 to a flat edge 423 formed on the top plate 422. Each of the flat edges 423 and 427 are transverse to the central axis 335. The bottom plate 424 has a low-friction underside 420, allowing the plug removal device 400 to slide easily and continuously on a flat surface without buckling or catching, such as the swim deck 202 near the debris cleanout access 206 (FIG. 2). The low-friction underside 420 encircles the debris cleanout access 206 so that the plug removal device 400 will move laterally and self align with the plug 300 when a load is applied to the plug removal device 400 along the plug axis 335 so that lateral loads are minimized as the plug 300 is removed. In embodiments, the underside 420 of the plug removal device 400 is coated with a low friction material such as fluoropolymers, PVC, high density polyvinyl chloride, carbon films, polytetrafluoroethylene, a combination of polymers, polymer coatings, wheels, bearings, casters, and the like.

Still referring to the plug removal device 400 in FIG. 4, a hex nut 428 is carried in the top plate 422 and is aligned along a central axis 435. A threaded shank, or threaded rod 403 is threaded through the hex nut 428 for rotational movement in the hex nut 428 with respect to the framework 402. A handle 432 is secured to a top end of the rod 403. The handle 432 allows the jet boat operator to more easily grip and rotate the threaded rod 403. Rotation of the rod 403 imparts translational movement to the bottom end of the rod 403, moving the rod 403 between extended and retracted positions.

A shackle 433 is fit onto the bottom end of the rod 403 with a clevis pin. A rotating clasp 454 is secured on the shackle 433. The first loop 308 of the lanyard assembly 304 is coupled for rotation to the rotating clasp 454, and the lanyard assembly 304, in operation, is threaded through the opening 425. The lanyard assembly 304 is a flexible tether from the rotating clasp 454 and can be coupled to the handle 314 of the plug 300.

Together, the handle 432, the threaded rod 403, the shackle 433, the rotating clasp 454, and the lanyard assembly 304 define a retracting means 404 for producing a retracting force along a retracting axis A. The retracting axis A is the direction along which the retraction force producing by the retracting means 404 is effected, and is generally parallel to and extends through the lanyard assembly 304. The retracting means 404 is supported by the framework 402 at an elevated position about the swim deck 202 in the top plate 422 and moves from an extended position, shown in FIGS. 4 and 6, to a retracted position, shown in FIG. 7, in response to rotation of the threaded rod 403 through the hex nut 428. In the extended position, the threaded rod 403 is extended through the top plate 422, so that the bottom end of the threaded rod 403 is far from the top plate 422 and close to the bottom plate 424. In the retracted position, the threaded rod 403 is drawn up, so that the bottom end of the threaded rod 403 is close to the top plate 422. The threaded rod 403, fixed in the framework 402 at the hex nut 428 in the top plate 422, is prevented from lateral movement parallel to the bottom plate 424. The lanyard assembly 304 is coupled to tilt, swing, pivot, rotate, and generally move in any direction at the bottom end of the threaded rod 403 through the shackle 433 and the rotating clasp 454. When the retracting force applied along the retracting axis A is transverse to the central axis 435, the retracting means 404 will tend to straighten, so that the threaded rod 403 is urged toward alignment with the lanyard assembly 304. Since the underside 420 has a low coefficient of friction, alignment of the threaded rod 403 with the lanyard assembly 304 is most readily achieved by the framework 402 translating laterally, which causes the threaded rod 403 to become disposed over the lanyard assembly 304, thus aligning the retracting axis A with the central axis 435. Therefore, in response to the retracting means 404 moving from the extended position to the retracted position, the bottom plate 424 moves in sliding, continuous contact across the swim deck 202 to align the central axis 435 with the retracting axis A.

Figure 5:
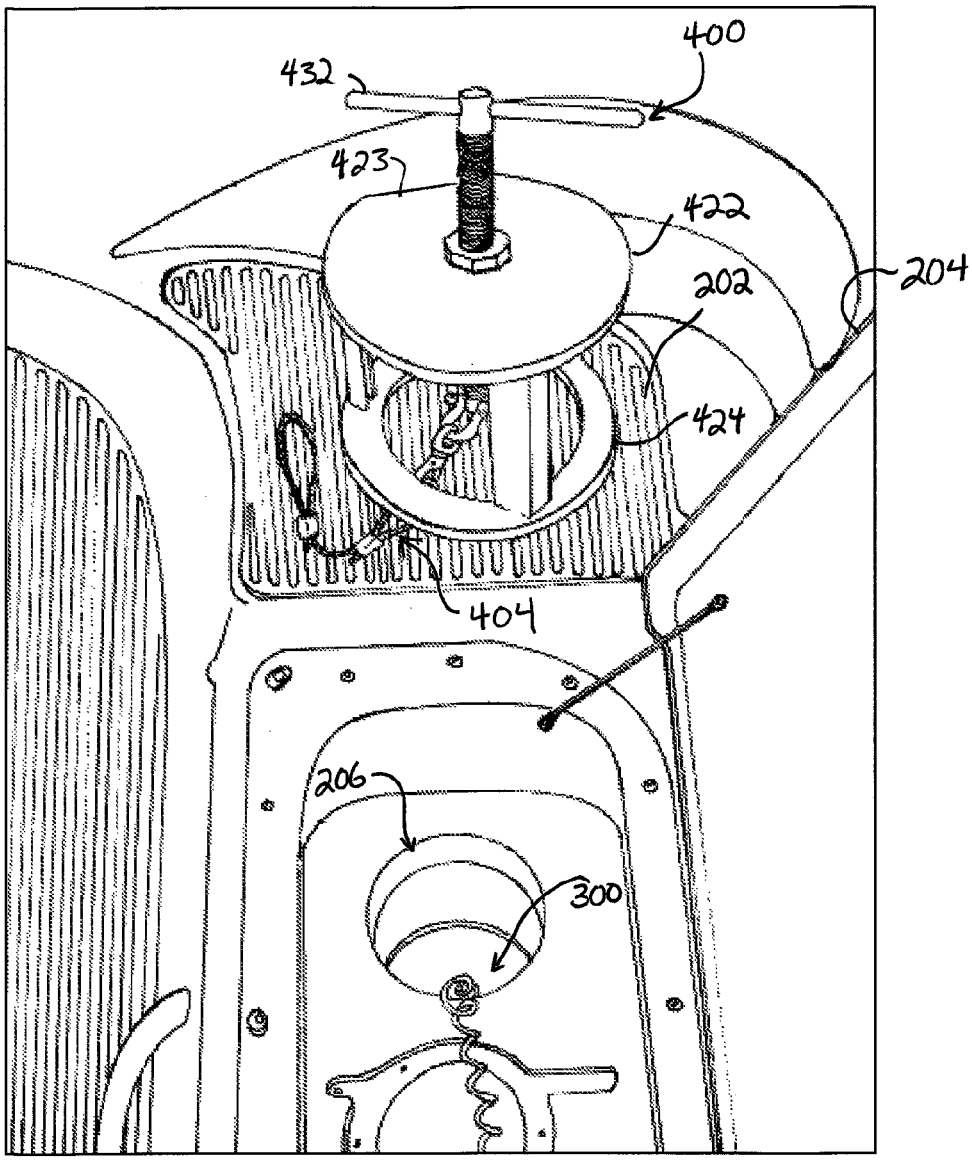
FIG. 5 is a top perspective view of the plug removal device of FIG. 4 resting on a swim deck of the jet boat, adjacent to the debris cleanout access of FIG. 2.
Figure 6:
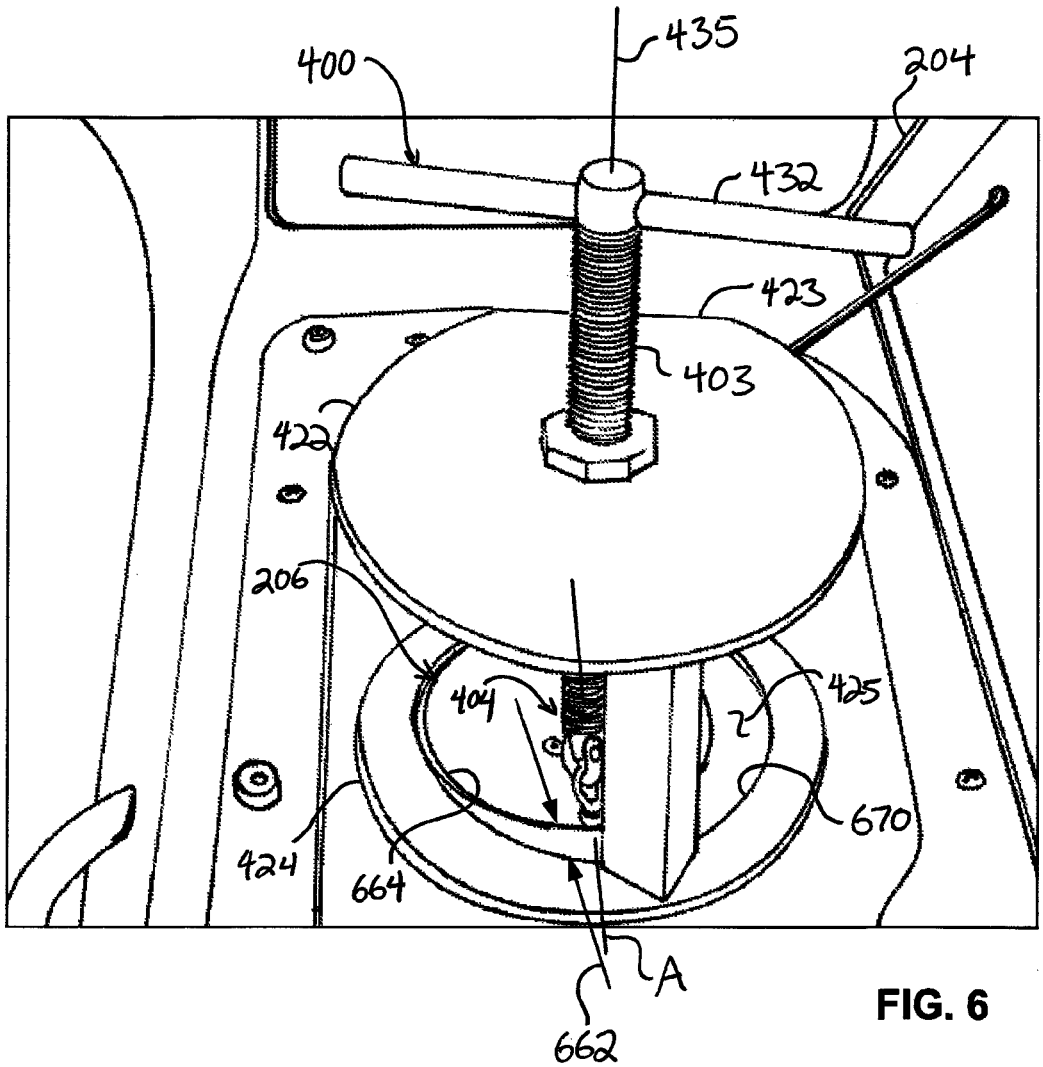
FIG. 6 is a top perspective view of the plug removal device of FIG. 4 disposed over and misaligned with the debris cleanout access plug.

FIG. 5 illustrates the plug removal device 400 resting on the swim deck 202 near the debris cleanout access 206, ready for application over the debris cleanout access 206 for removal of the plug 300. Referring now to FIG. 6, the plug removal device 400 is disposed over the debris cleanout access 206. The opening 425 of the bottom plate 424 of the plug removal device 400 is misaligned with the center of the debris cleanout access 206. Specifically, the opening 425 is off-center and not coaxial to the debris cleanout access 206; a gap 662 measured from an inside edge 670 of the bottom plate 424 bounding the opening 425 to an outer edge 664 of the debris cleanout access 206. The underside 420 has a low coefficient of friction and is constructed out of a material or combination of materials having such low-friction characteristics, such as plastics, polymers, ball bearings, and the like known by those of skill in the art. This allows the underside 420 to slide in continuous contact along the swim deck 202 so that the center of the circular opening 425 in the bottom plate 424 self-aligns coaxially over the debris cleanout access 206 in response to the retracting force directed along the retracting axis A aligning with the central axis 435. With the plug removal device 400 so aligned, the plug removal device can be further operated to remove the plug 300.

Figure 7:
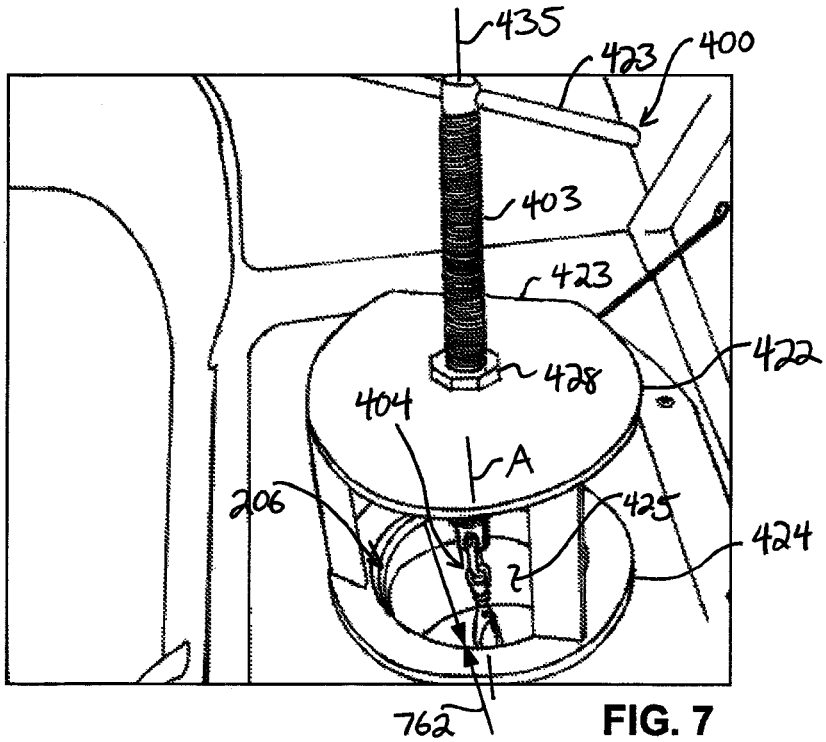
FIG. 7 is a top perspective view of the plug removal device of FIG. 4 disposed over and aligned with the debris cleanout access plug.
Figure 8:
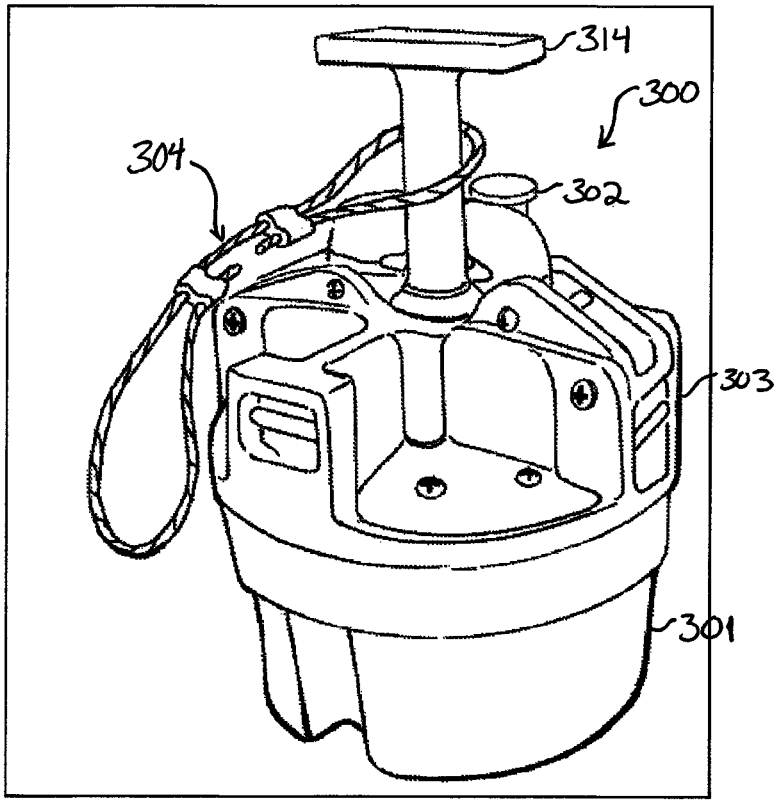
FIG. 8 is a perspective view of the debris cleanout access plug in isolation.

FIG. 7 shows the plug removal device 400 as the threaded rod 403 is rotated counter-clockwise so as to cause the retracting means 404 to apply the upward retracting force to the plug 300. As the retracting force is applied, the plug removal device 400 self-aligns, according to the method described above, so as to reduce the gap 662 (shown in FIG. 6) to a smaller gap 762 until the plug removal device 400 is centered over the plug 300. The self alignment of the plug removal device 400 reduces any lateral forces applied on the plug 300. The threaded rod 403 is rotated further, causing the retracting force acting on the plug 300 to increase. Eventually, the plug 300 will pop free and be removed from the debris cleanout access 206. FIG. 8 shows the plug 300 in isolation, removed from the debris cleanout access 206.

Figure 10:
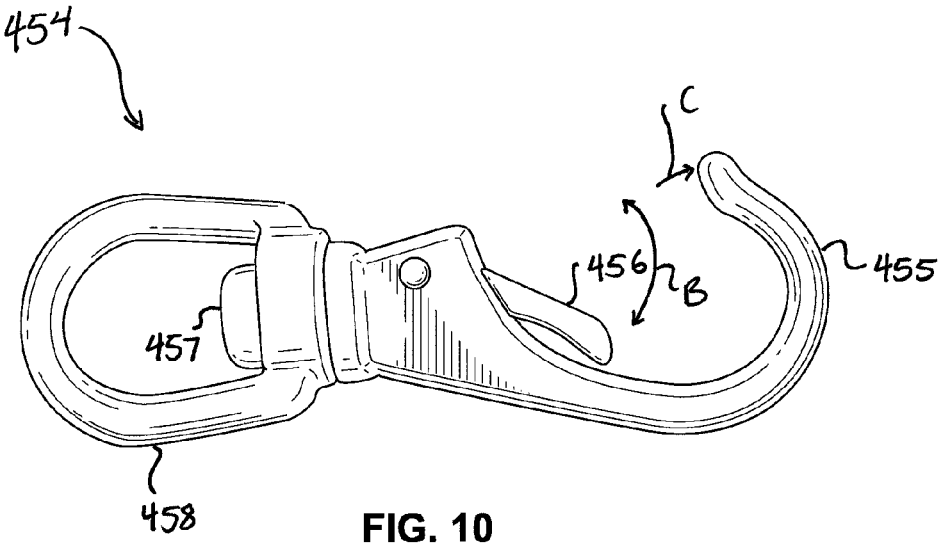
FIG. 10 is a side elevation view of a shackle used with the plug removal device of FIG. 4.
Figure 11:
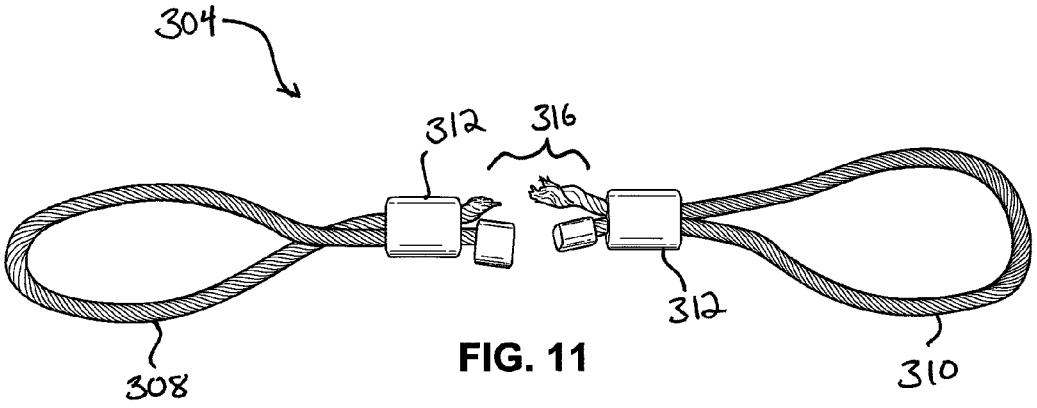
FIG. 11 is a side elevation view of a lanyard used with the plug removal device of FIG. 4.

The plug removal device 400 is designed to prevent damage to the jet boat 100. The rotating clasp 454 and the lanyard assembly 304 each are designed to prevent such damage. FIGS. 10 and 11 illustrate the rotating clasp 454 and the lanyard assembly 304, respectively, in failed conditions, which result so as to prevent damage to the jet boat 100. The swim deck 202, in particular, is vulnerable to cracking and breaking, because the swim deck 202 is often a thin platform constructed of plastic. The swim deck 202 will yield, in the form of either deformation, micro-cracking, cracking, or breaking, at a localized force greater than 350 pounds.

Referring to FIG. 10 first, the rotating clasp 454 includes a fixed jaw 455 and a pivoted jaw 456 mounted for movement toward and away from the fixed jaw 455, and, opposed from the fixed and pivoted jaws 455 and 456, a post 457 on which a clasp shackle 458 is mounted for rotation. The pivoted jaw 456 typically moves along line B between an open position, approximately shown in FIG. 10, and a closed position, in which the pivoted jaw 456 is proximate to the fixed jaw 455 and the fixed and pivoted jaws cooperate to define a retaining space of the rotating clasp 454 for receiving the lanyard assembly 304. The clasp shackle 458 is permanently coupled to the shackle 433 secured on the bottom end of the threaded rod 403. The rotating clasp 454 is constructed from a material or combination of materials having material characteristics of rigidity, strength, and durability. The rotating clasp 454, however, has a particular yield strength at which the rotating clasp 454 will yield and in some circumstances will even break. When the threaded rod 403 is rotated so as to create the retracting force through the retracting means 404, as described above, the clasp shackle 458 and the fixed jaw 455 are subjected to that retracting force. The fixed jaw 455 yields at a force of approximately 200 pounds, so that as the retracting force increases to 200 pounds, the fixed jaw 455 yields and deforms outwardly along arrowed line C in FIG. 10. The fixed jaw 455 yields until it reaches the failed condition of the rotating clasp 454, shown in FIG. 10, in which the lanyard assembly 304 slips off the fixed jaw 455 and the retracting means 404 is severed, thereby releasing the plug 300 and terminating the application of the retraction force. In this way, because the yield strength of the fixed jaw 455 is less than the force required to break the swim deck 202, the retracting means 404 breaks when the retracting force is equal to the yield strength and before the retracting force equals the force required to break the swim deck 202. This prevents damage to the swim deck 202.

Referring now to FIG. 11, the lanyard assembly 304 is shown. The lanyard assembly 304 includes the first loop 308 formed with one of the clamps 312, the second loop 310 formed with another one of the clamps 312, and a break section 316 extending between the clamps 312 on the first and second loops 308 and 310. The break section 316 is shown in a severed, or failed, condition in FIG. 11 but is indicated generally with the reference character 316. As described above, the lanyard assembly 304 is formed from twisted cable, preferably made of metal. The cable is twisted and constructed so that the lanyard assembly 304 has an ultimate tensile strength of between 200 and 300 pounds, and preferably of 184 pounds, beyond which the lanyard assembly 304 will break, as shown in FIG. 11. When the threaded rod 403 is rotated so as to create the retracting force through the retracting means 404, as described above, the lanyard assembly 304 is subjected to that retracting force. As the retracting force increases to 184 pounds, the lanyard assembly 304 yields and the break section 316 will sever, defining the failed condition of the lanyard assembly 304. The retracting means 404 is thus severed, thereby releasing the plug 300 and terminating the application of the retraction force. In this way, because the yield strength of the lanyard assembly 304 is less than the force required to break the swim deck 202, the retracting means 404 breaks when the retracting force is equal to the yield strength and before the retracting force equals the force required to break the swim deck 202. This prevents damage to the swim deck 202.

Figure 9:
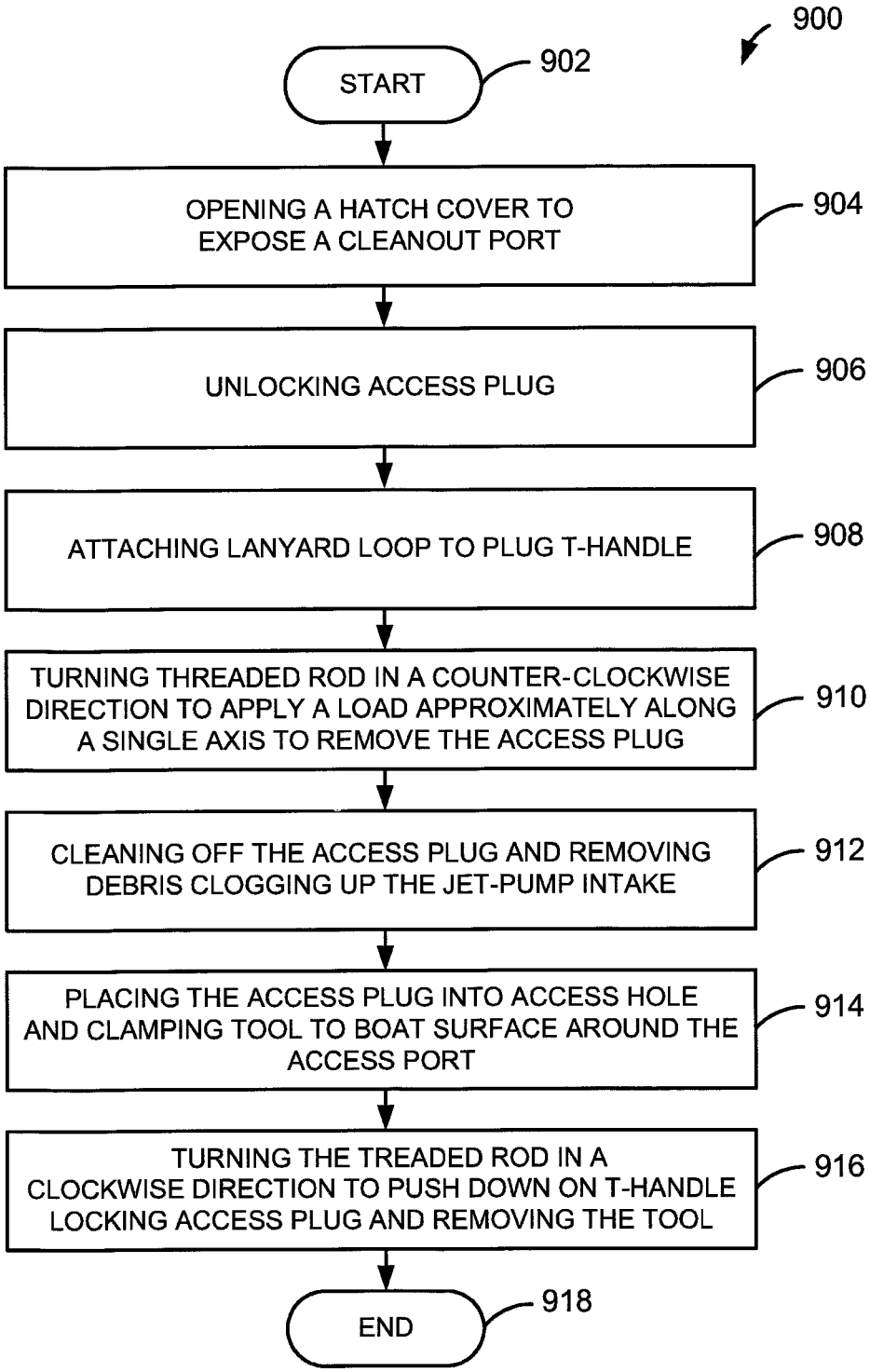
FIG. 9 is a block diagram illustrating a method of removing and reinstalling a debris cleanout access plug.

According to yet another exemplary aspect of the present invention, FIG. 9 is a schematic block diagram of a method 900 illustrating a method of removing and installing the plug 300 according to the method 900. The method 900 is described with reference to all of the FIGS. While the method 900 is illustrated and described herein as a series of acts or events, it will be appreciated that the present invention is not limited by the illustrated ordering of such acts or events, as some acts or events may occur in different orders and/or concurrently with other steps apart from that shown and described herein, in accordance with the invention. In addition, not all illustrated acts may be required to implement a methodology in accordance with the present invention. Moreover, it will be appreciated that the method 900 may be implemented in association with the systems illustrated and described herein as well as in association with other systems, not illustrated.

As illustrated in FIG. 9, the method 900 starts at step 902. At step 904, the jet boat operator exposes the debris cleanout access 206 by opening the hatch cover 204, which remains open, preferably by utilizing a hatch cover latching device. The debris cleanout access 206 allows access to the plug 300 and is normally constructed so as to be directly over the jet-pump intake on a swim deck 202 providing easy access to the plug 300 on a jet boat 100.

At step 906, the access plug 300 is unlocked by pushing on the unlock button 302. At step 908, the first loop 308 is attached to the handle 314 of the plug 300. The lanyard assembly 304 is attached to the plug removal device 400 at the rotating clasp 454 attached to the shackle 433. At step 910, the plug 300 is removed by rotating the threaded rod 403 in a counter-clockwise direction to apply a retracting force through the retracting means 404 along the retracting axis A. In response to the retracting means 404 producing the retracting force, the framework 402 moves along the swim deck 202 to align the retracting axis A with the central axis 435. As the retracting force on the plug 300 increases, the plug removal device 400 self aligns as described above so that the lanyard assembly 304 applies the retracting force along the retracting axis A which is aligned with the plug axis 335. The plug 300 is removed from the debris cleanout access 206.

At step 912, with the plug 300 removed from the debris cleanout access 206, the plug 300 is cleaned off: any barnacles, salt deposits, or other debris on the plug 300 is cleaned, and any debris clogging the jet-pump intake is taken out and discarded. At step 914, the plug 300 is re-installed in the debris cleanout access 206 by placing the plug 300 into the debris cleanout access 206 and clamping the plug removal device 400 to the swim deck 202 around the debris cleanout access 206. At step 916, the threaded rod 403 is rotated in a clockwise direction to push down on the handle 314 of the plug 300 so as to depress and lock the plug 300 in the debris cleanout access 206. Alternatively, the operator may simply push and lock the plug 300 in the debris cleanout access 206 by hand. The plug removal device 400 is then removed, after which the method 900 ends at step 314.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A plug removal device comprising:

a base having a contact face continuously encircling an opening, and a central axis extending through the base through the opening;

the contact face of the base is smooth and defines a low-friction surface for juxtaposition with a flat surface;

retracting means supported at an elevated position above the base, the retracting means produces a retracting force and includes a threaded shank and a flexible tether rotatably coupled to the threaded shank and terminating in a catch;

the retracting means moves along a retracting axis from an extended position to a retracted position; and in response to the retracting means moving from the extended position to the retracted position, the base moves to align the central axis with the retracting axis.

2. The plug removal device of claim 1, wherein the retracting means breaks when the retracting force is equal to a predefined break strength.

3. The plug removal device of claim 1, wherein the flexible tether breaks when the retracting force is equal to a predefined break strength.

4. The plug removal device of claim 1, wherein:

a clasp rotatably couples the tether to the shank; and the clasp breaks when the retracting force is equal to a predefined break strength.

5. The plug removal device of claim 1, wherein rotation of the threaded shank moves the retracting means between the extended and retracted positions.

* * * * *